US008701957B2

(12) United States Patent
Grandjean et al.

(10) Patent No.: US 8,701,957 B2
(45) Date of Patent: Apr. 22, 2014

(54) METHOD FOR CONTROLLING AN INTERNAL COMBUSTION ENGINE TOOL AND THE THUS CONTROLLED TOOL

(75) Inventors: Pascale Grandjean, Guilherand-Granges (FR); Pierre Cordeiro, Livron sur Drome (FR); Jean-Michel Dreveton, Valence (FR)

(73) Assignee: Societe de Prospection et d'Inventions Techniques SPIT, Bourg les Valence (FR)

( * ) Notice: Subject to any disclaimer, the term of this patent is extended or adjusted under 35 U.S.C. 154(b) by 290 days.

(21) Appl. No.: 13/009,026

(22) Filed: Jan. 19, 2011

(65) Prior Publication Data

US 2012/0138655 A1 Jun. 7, 2012

(30) Foreign Application Priority Data

Jan. 26, 2010 (FR) ..... 10 50525

(51) Int. Cl.
*B25C 1/08* (2006.01)

(52) U.S. Cl.
USPC ..... 227/9; 227/130

(58) Field of Classification Search
USPC ..... 227/2, 8, 9, 10, 130; 123/479; 361/154, 361/152
See application file for complete search history.

(56) References Cited

U.S. PATENT DOCUMENTS

| | | | | |
|---|---|---|---|---|
| 4,862,866 | A * | 9/1989 | Calfus | 123/490 |
| 5,335,136 | A * | 8/1994 | Locher et al. | 361/160 |
| 6,213,370 | B1 | 4/2001 | Walter | |
| 6,722,550 | B1 * | 4/2004 | Ricordi et al. | 123/46 SC |
| 6,934,140 | B1 * | 8/2005 | Rober et al. | 361/154 |
| 7,084,637 | B2 * | 8/2006 | Gaessler et al. | 324/381 |
| 7,124,741 | B2 * | 10/2006 | Cagnoni et al. | 123/472 |
| 7,401,595 | B2 * | 7/2008 | Kimura et al. | 123/490 |
| 2003/0062029 | A1 * | 4/2003 | Oyama et al. | 123/490 |
| 2006/0042574 | A1 | 3/2006 | Nishikawa et al. | |
| 2006/0283909 | A1 | 12/2006 | Shima et al. | |
| 2007/0227506 | A1 * | 10/2007 | Perryman et al. | 123/479 |

FOREIGN PATENT DOCUMENTS

| | | | |
|---|---|---|---|
| EP | 1388394 | A1 | 2/2004 |
| FR | 2887958 | A1 | 1/2007 |
| WO | 2007-004024 | A1 | 1/2007 |
| WO | WO 2007004024 | A1 * | 1/2007 |
| WO | 2007/061808 | A2 | 5/2007 |

OTHER PUBLICATIONS

French Search Report for FR1050525 dated Jul. 27, 2010.

* cited by examiner

*Primary Examiner* — Thanh Truong
*Assistant Examiner* — Nathaniel Chukwurah
(74) *Attorney, Agent, or Firm* — Lowe Hauptman & Ham LLP

(57) ABSTRACT

This invention relates to controlling a tool for driving fastening elements through firing a fuel. A valve, upon each shot, opens via a current ($I_A$) in a component created by a voltage injection control ($U_v$). Upon the first one of a series of shots and after the control, the time $t_o$ is detected of a drop of current in a measuring member upon the transient rise of current and, the opening period $T_o$ of the valve being predetermined, the end of the injection control is triggered at the time $t_d$, after a period $T_o$, following the time $t_o$, reduced with a period $T_o$, of a first rise of the voltage injection control following the beginning of the drop of current or a rise, following the beginning of its drop, of the current.

18 Claims, 4 Drawing Sheets

METHOD FOR CONTROLLING AN INTERNAL COMBUSTION ENGINE TOOL AND THE THUS CONTROLLED TOOL

RELATED APPLICATIONS

The present application is based on, and claims priority from, French Application Number 1050525, filed Jan. 26, 2010, the entire contents of which is hereby incorporated by reference.

The invention has its origin in the problem of the responses to the control impulsions from solenoid valves for injecting and dosing the driving fuel in the combustion chamber of the internal combustion engine of so-called gas-driven fastening tools arranged for driving fastening elements of the nail or staple type in supporting materials.

Such a solenoid valve acts as a tap, being arranged between a fuel cartridge and the combustion chamber, being opened for some time so that an appropriate fuel dose flows from the cartridge into the combustion chamber.

Schematically, a solenoid valve could comprise a magnetic core perforated with a flowing channel extending between an intake mouthpiece and an ejection mouthpiece, with an intermediary cavity wherein a spring membrane is located, carrying a valve for the ejection mouthpiece being distorted under the action of a magnetic field created in the core by a current crossing a core surrounding coil. At rest, the membrane is not distorted and the valve thereof plugs the ejection mouthpiece. When the coil is switched on and crossed by a current, the membrane becomes distorted and the valve thereof uncovers the flowing hole of the ejection mouthpiece; then the solenoid valve opens.

Controlling a solenoid valve, that is controlling the opening thereof, occurs through a voltage slot intended, by its ascending front edge, to open the solenoid valve and close via its descending front edge. Practically (FIGS. 1 and 2) the current starts to be established in the coil, at the time $t_m$, at the ascending front edge of the controlling slot, for progressively increasing upon a transient rise during which the core remains at rest. Only after a small current drop, practically instantaneous, at a time $t_o$, does the core reach its activated state, from which the solenoid valve is considered as being opened. After such a current drop, the value of the current increases so as to rapidly reach its high level where it is kept until the descending front edge of the control voltage slot, at the time $t_d$. The solenoid valve still remains opened beyond that, as the descending front edge of the voltage slot is followed by an increased voltage up to its neutral level; in two times, separated by a small drop ending at the time $t_f$, where the solenoid valve is closed, if the discharge of the coil of the solenoid valve is stabilized by a circuit comprising a Zener diode. Otherwise, the current signal in the coil is subjected, at the time $t_f$, to a small rise after the beginning of its drop. The solenoid valve thus remains opened during the period $T_o$ $$T_o=t_f-t_o$$

Finally, the ascending and descending front edges of the voltage control slot occur at times $t_m$ and $t_d$ and the solenoid valve remains opened from the time $t_o$ to the time $t_f$. As fuel dosing in the combustion chamber of the tool depends on the opening time of the solenoid valve and thus also on the time intervals $T_{ON}=t_o-t_m$ and $T_{OFF}=t_f-t_d$, the problem lying at the origin of the invention of the present application is the scattering of the intervals $T_{ON}$ and $T_{OFF}$ varying from one solenoid valve to the other, for both electric as well as mechanical reasons.

Otherwise stated, the Applicant raised the problem of compensating the opening time drift for the solenoid valves and thus, keeping under control fuel doses in the combustion chamber of so-called gas-driven fastening tools. Furthermore, the Applicant raised the more general problem of the electrical device drift for feeding fuel into the combustion chamber of gas-driven fastening tools, such devices comprising a valve opening under the action of a current in a component created by a voltage control signal. This is indeed the case still of a piezoelectric injecting device. It should be noticed that the quartz of a piezoelectric injecting device is for the injecting device what the coil is for the solenoid valve.

Thus, first of all the invention relates to a control method for an internal combustion engine hand tool, for driving, in a supporting medium, fastening elements under the action, upon a shot, of firing, in a combustion chamber of the engine, a driving fuel transferred into the chamber from a fuel cartridge through a fuel intake electrical device (1), the device (1) comprising a valve which, upon each shot opens in an intake position, under the action of a current ($I_A$) in a component created by a voltage injection control signal ($U_v$), a method characterized in that, during a first of a series of shots and after the beginning of the control signal, there is detected the time $t_o$ of a current drop upon the transient current rise, and, the opening period To of the valve being predetermined, the end of the injection control signal is triggered at the time $t_d$, after a period $T_o$, following the time $t_o$, reduced with an estimated period $T_{OFF}$, of a first rise of the voltage injection control signal following the beginning of the current signal drop in said component or a rise, following the beginning of the current signal drop in said component.

Depending on whether the discharge of the coil of the solenoid valve—the component the current of which opens the valve—is stabilized or not by a voltage controlling circuit comprising for example a Zener diode, the period $T_{OFF}$ starts at the time $t_d$ and ends either upon the first rise of the voltage injection control signal, or at the small rise of the current signal in the coil following the drop thereof.

In the first case of the voltage stabilisation, as perfectly described in the French patent 2,887,958, if it is a Zener diode, which becomes passing as soon as its threshold voltage is reached, it causes a rapid discharge of the coil and a rapid rise of the voltage control signal: the period $T_{OFF}$ is short and practically constant from one shot to the other. The scattering of $T_{OFF}$ is very weak.

Instead of a Zener diode, a plurality of control diodes could be proposed.

In contrast, in the second case, with no stabilisation Zener diode, the voltage control signal rises very slowly. At the time $t_f$ of the closing contact, the valve closes, resulting in a slight rise of the current in the coil.

It is to be understood that practically, the response time of the valve for the fuel intake electric devices does not significantly change from one shot to another, so that it is indeed sufficient to only implement the control method of this invention from time to time and not upon every shot, although this would also be possible. It is still to be noticed that the period of the small voltage drop following the first rise, in the case of the stabilisation by a Zener diode, could be considered as negligible.

In the case where the discharge of the component, from the fuel intake electric device and the current of which opens the valve, is stabilised, the end of the injection control signal is triggered at the time $t_d$, after a period $T_o$, following the time $t_o$, reduced with a practically constant period $T_{OFF}$ of a first rise of the voltage injection control signal.

If the discharge of component, from the fuel intake electric device and the current of which opens the valve, is not stabilised, the end of the injection control signal is triggered at the time $t_d$, after a period $T_o$, following the time $t_o$, reduced with an estimated period $T_{OFF}$, of a rise, following the beginning of the drop thereof, of the current signal in said component.

In such a case, the true period $T_{OFF}$ of the current signal rise in said component following the beginning of the drop thereof is measured at the time $t_d$ and is substituted for the estimated period $T_{OFF}$ at least for the following shot following the series of shots.

The voltage injection control signal $U_v$ is a slot; the control signal may be the envelope of a series of pulses, including of a generator PWM (pulse width modulation).

By means of this invention, modifications, alternatives and other alterations of the solenoid valves and piezoelectric injectors are well compensated. The injection and dosage openings thereof are optimized.

This invention also relates to an internal combustion engine hand tool, for driving in a supporting material fastening elements under the action, upon a shot, of the firing, in a combustion chamber of the engine, of a driving fuel transferred in the chamber from a cartridge of fuel by a fuel intake electric device, the device comprising a valve which, upon each shot, opens in the intake position under the action of a current ($I_A$) in a component created by a voltage injection control signal ($U_v$), said tool being characterized in that it further comprises a current measurement member in series with the fuel intake electric device and a microcontroller arranged for receiving the outlet signal of the current measurement member and the injection control signal ($U_v$) of the intake device and computing the opening time of the fuel intake device.

Preferably, the microcontroller comprises a processing circuit for detecting the mechanical opening and closing of the intake electric device.

Advantageously, the fuel intake device is controlled by a power stage controlled by a circuit in the microcontroller for computing the opening time of the intake device and connected, at the input, to the processing circuit of the microcontroller.

In the case where the fuel intake device is a solenoid valve, comprising a coil, the current measurement member is in series with the coil.

Advantageously, there is provided a voltage protecting and controlling and stabilizing circuit in parallel on the intake device, this could comprise a discharge diode and a voltage control Zener diode, both able to be serially mounted.

This invention will be better understood reading the following description of the implementation of the control method and the preferred embodiment of the hand tool of this invention, referring to the appended drawing wherein.

Figure 1:
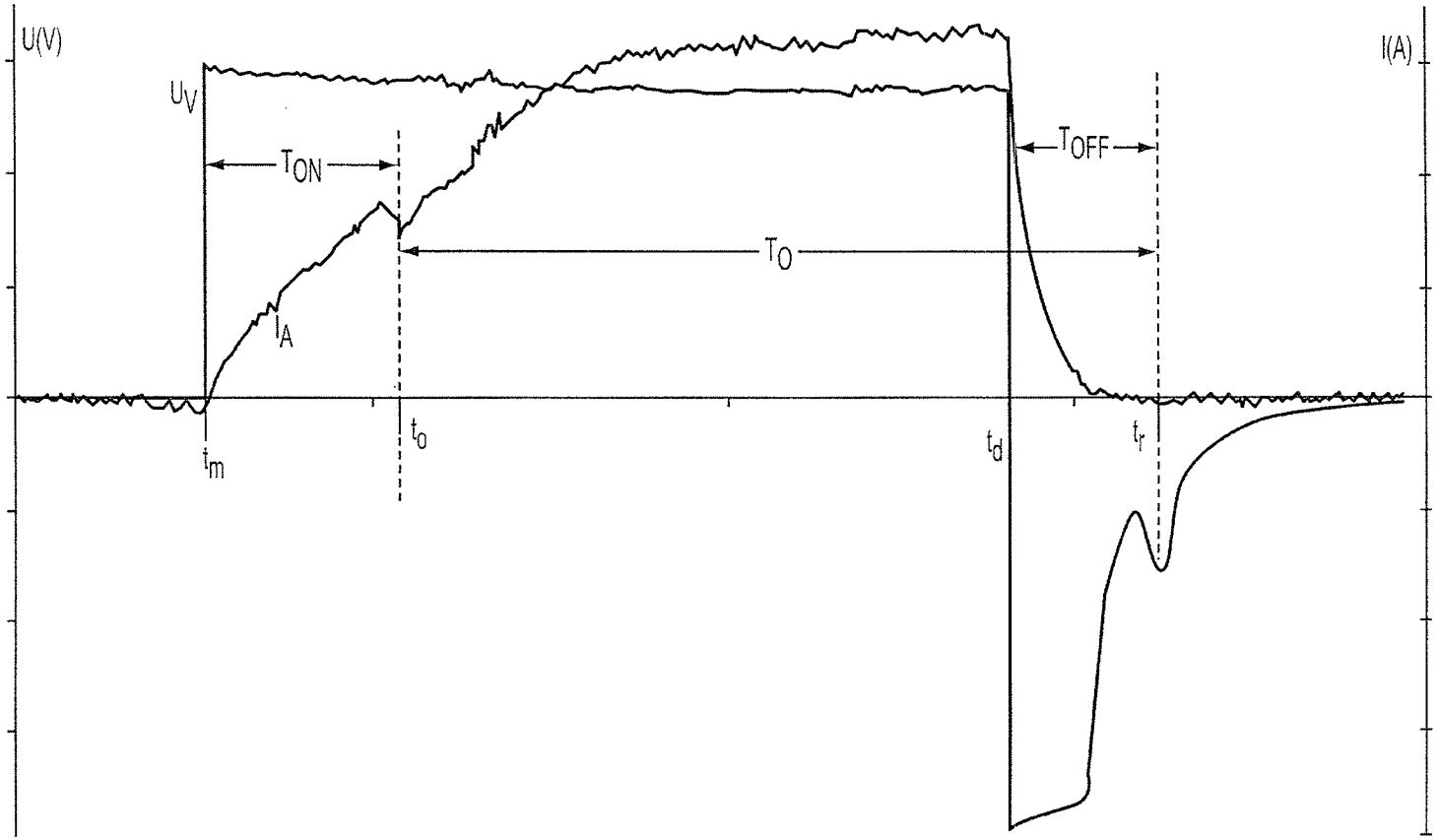
FIG. 1 is the diagram of a voltage control slot for opening the valve of the fuel intake device in the combustion chamber of the hand tool and the diagram of the resulting current signal in the component directly controlling the valve, the discharge of such a component being stabilised by a Zener diode.
Figure 2:
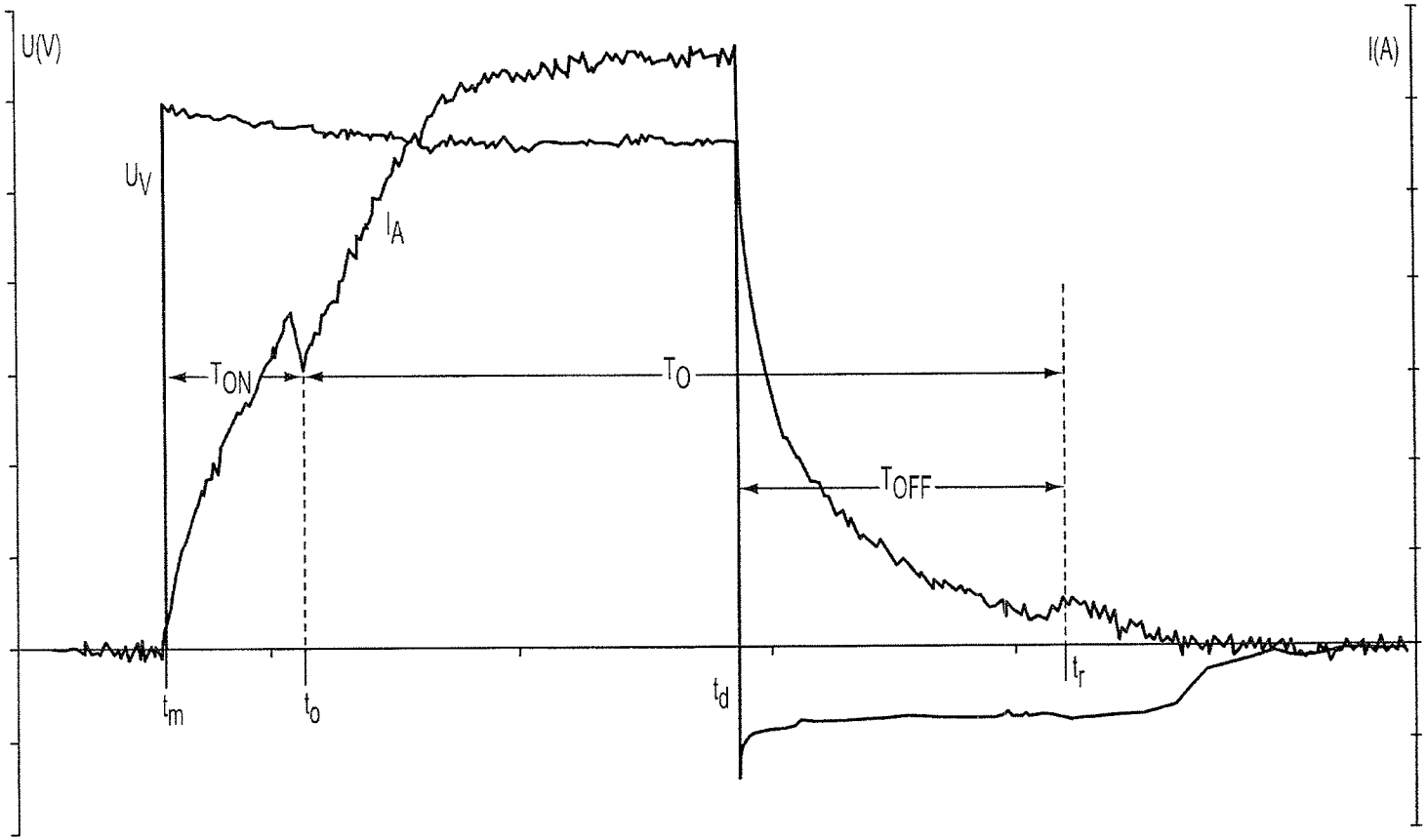
FIG. 2 is the diagram of a voltage control slot for opening the valve of the fuel intake device in the combustion chamber of the hand tool and the diagram of the resulting current signal in the component directly controlling the valve, the discharge of such a component being not stabilised.

FIG. 1 has already been described herein above. It should only be stated here that on the two diagrams being represented thereon, that of the voltage impulsion and that of the current impulsion, the time is represented thereon in abscissa in seconds (s) and in ordinate, the current I is represented thereon in amperes (A), on the left, for the current impulsion $I_A$, the voltage U is represented thereon in volts (V), on the right, for the voltage impulsion $U_v$.

The tool, the control circuit of which will be described of the fuel intake electric device in the combustion chamber and thus the method for its control is a hand tool of the nailing device type, with a fuel intake solenoid valve 1, comprising a coil 15 causing the opening of the solenoid valve and the intake into the combustion chamber of the tool from a gas cartridge 16 through an intake manifold 17.

It should be noticed that the invention also applies to a stapler, a driller, or even to an anchoring resin injecting device. This invention applies to a solenoid valve but also to any other intake device comprising an intake valve, such as for example a piezoelectric injecting device.

To take again the example of the solenoid valve 1, it is thus controlled by a microcontroller 2. It is mounted serially, in this particular case, its coil 15, with a current measurement member 3 and controlled in voltage by a power stage 4.

The power stage 4 is mounted, at the outlet, in parallel on the serial assembly of the solenoid valve 1 and the current measurement member 3, across the battery (5, 6) of the tool at the input. It is to be noticed that the terminal 6 of the battery is earthed. A voltage protecting and controlling circuit 7 is mounted in parallel on the assembly 1, 3 as well as on the power stage 4. The power stage 4 is here a power transistor stage. The circuit 7 comprises here a protecting diode 18 for the power stage 4, wherein the coil 15 can discharge, and, here still, a voltage controlling Zener diode 19, in series with the discharge diode 18 so as to reduce the discharge period and well stabilize it. Such an assembly is perfectly described in French patent 2,887,958. The current measurement member 3 essentially comprises a resistor. The microcontroller 2 comprises an analog-digital converter 8, a signal processing circuit 9 and a computation circuit 10 for calculating the opening time of the solenoid valve 1.

The computation circuit 10 is connected, at the outlet, to the control input 13 of the power stage 4, and, at the input, to the processing circuit (9). The current measurement member 3, delivering a current signal, is connected to one 11 of the inputs of the converter 8, another input 12 of the converter being connected to the control outlet 14 of the power stage 4 delivering a voltage signal.

After conversion of the current values IA and of the voltage values $U_v$, the processing circuit 9 determines, upon each shot, the time $t_o$ and the resulting time $t_d$, knowing $T_o$ and having upon the first shot, or the first one of a series, determined the practically constant value of $T_{OFF}$. If the circuit 7 did not comprise any Zener diode, the processing circuit 9, upon each shot or, even better, upon each shot of a series of shots, would have measured the true period $T_{OFF}$ for the following shot.

Otherwise stated, the processing circuit 9, would detect the mechanical opening and closing of the solenoid valve 1 at the times $t_o$ and $t_f$. As far as the computation circuit 10 is concerned, it would calculate for the time $t_d$ of triggering of the descending front edge of the control impulsion of the power stage 4 using the formula:

$t_d = t_o + T_o - T_{OFF}$

Alternatively, and within the context of a strictly similar identical concept, for apprehending the time $t_o$, from which the solenoid valve should be considered as opened, the time $t_f$, when the solenoid closes, and the time $t_d$ when the end of the injection control signal should be triggered, one could implement, no longer with the current/voltage signals, but with the signals as being delivered by a pressure sensor at the outlet of the intake device detecting fuel output.

Figure 3:
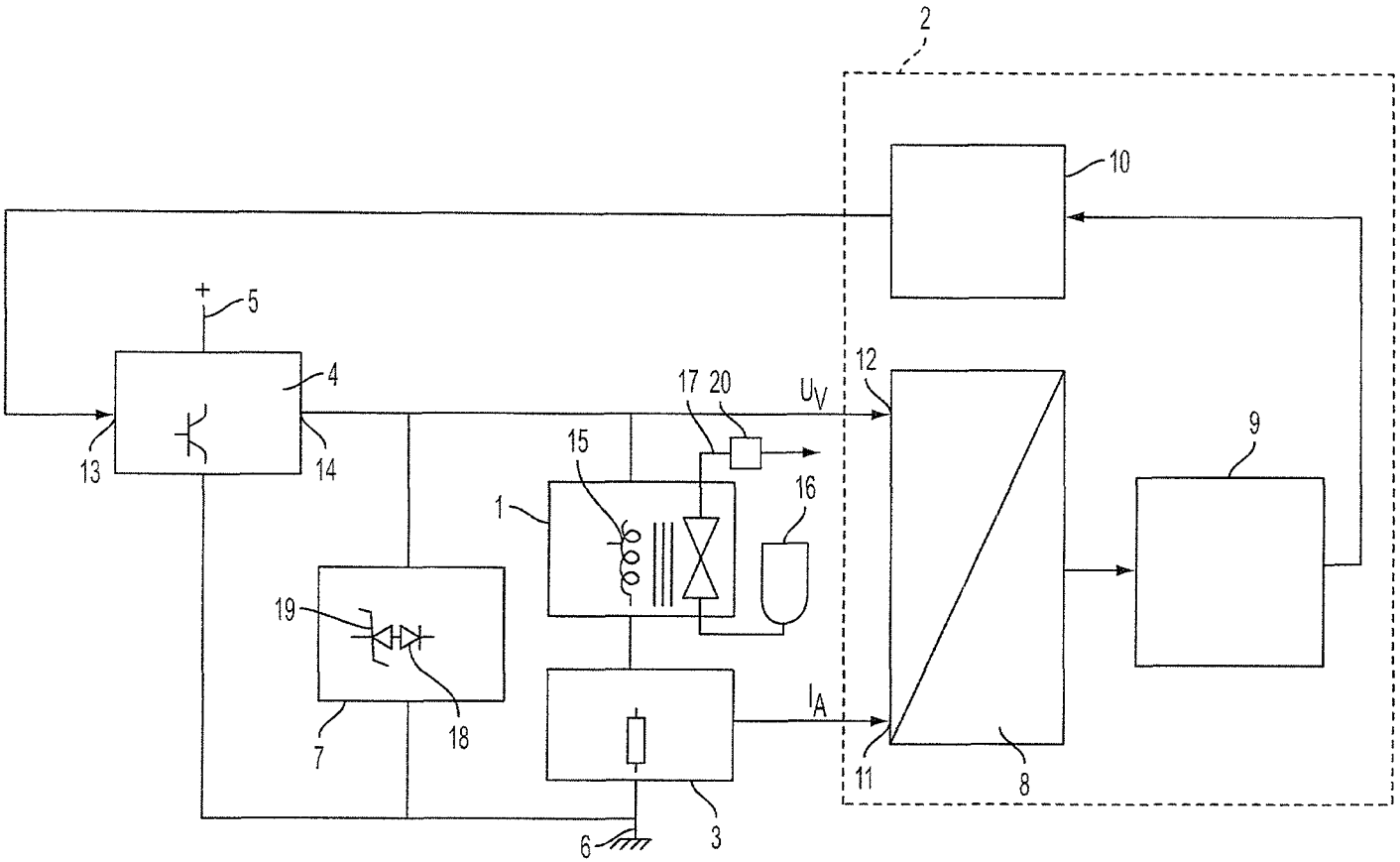
FIG. 3 shows the block diagram of the control circuit of the fuel intake device of the tool.
Figure 4:
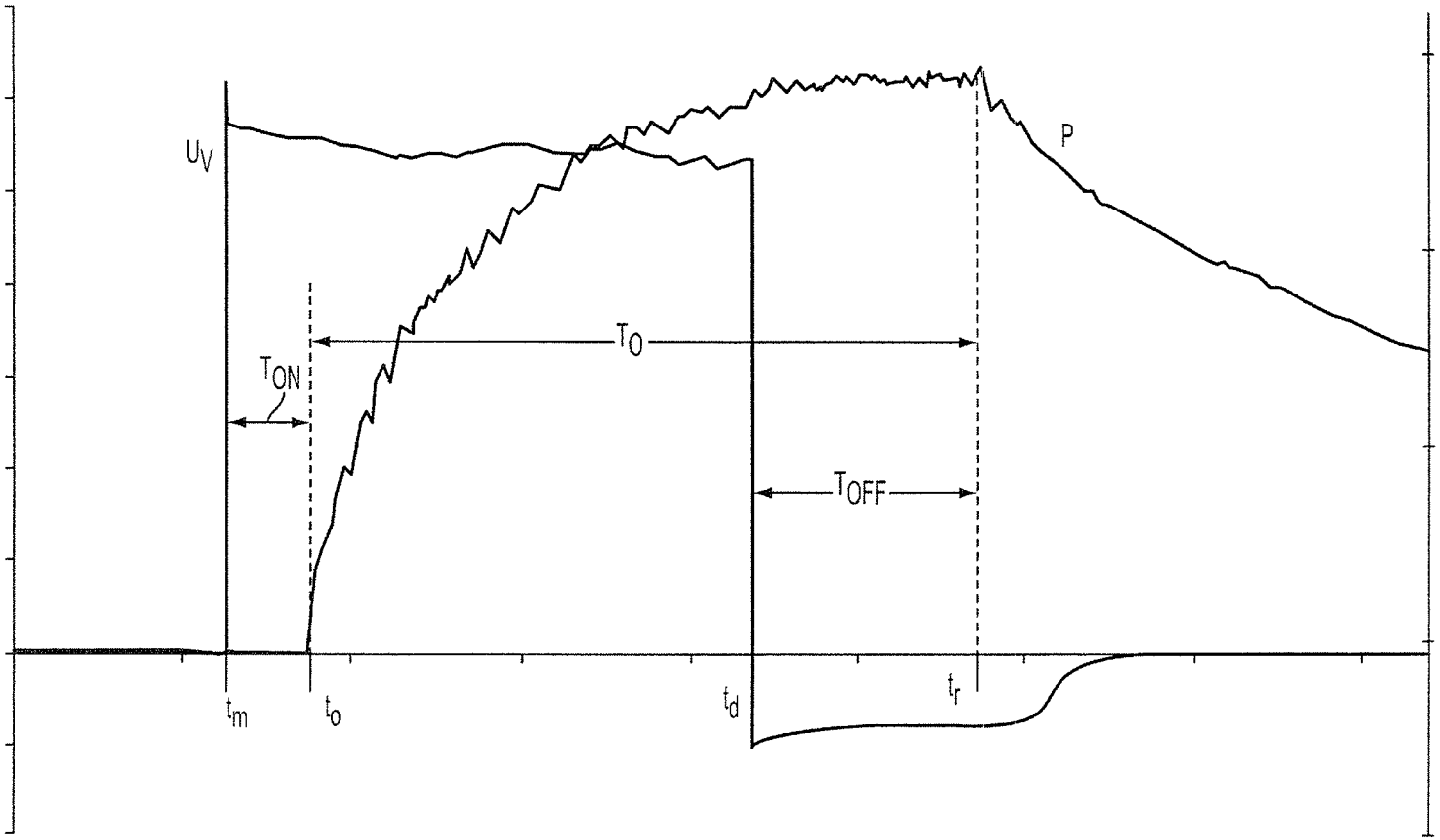
FIG. 4 is the diagram of a voltage control slot for opening the valve of the fuel intake device in the combustion chamber of the hand tool and the diagram of the resulting pressure signal in a pressure sensor in the outlet of the fuel intake device.

In the case of a pressure sensor 20 mounted in the manifold 17 (FIGS. 3, 4), at the time $t_o$, the pressure increases since the valve of the solenoid valve 1 opens and at the time $t_f$, the pressure starts to decrease as the solenoid valve closes.

Thus, this invention also relates to a method for controlling an internal combustion engine hand tool, for driving in a supporting material fastening elements under the action, upon a shot, of the firing, in a combustion chamber of the engine, of a driving fuel transferred in the chamber from a fuel cartridge by a fuel intake electrode device, the device comprising a valve which, upon each shot opens in an intake position, under the action of a current ($I_A$) in a component created by a voltage injection control signal ($U_v$), and a pressure sensor being mounted at the outlet of the intake device, said method being characterized in that, upon the first one of a series of shots and after the beginning of the control signal, the time $t_o$ is detected of the opening of the valve detecting the opening thereof through a rise of the pressure in the outlet of the intake device, and, the opening period $T_o$ of the valve being predetermined, the end of the signal of the injection control is detected, at the time $t_d$, after a period $T_o$, following the time $t_o$, reduced with an estimated period $T_{OFF}$, elapsing from the end of the injection control signal until the time $t_f$ of closing of the valve being detected by a pressure decrease at the outlet of the intake device, the true period $T_{OFF}$ of the pressure drop following the beginning of the current drop ($t_d$) is measured and is substituted for the estimated period $T_{OFF}$ at least for the following shot of the series of shots.

The voltage injection control signal remains of the same nature as previously.

This invention further relates to the tool as described above with, in addition, the pressure sensor at the outlet of the solenoid valve.

The invention claimed is:

1. A controlling method for an internal combustion engine hand tool, for driving in a supporting material fastening elements under an action, upon a shot, of firing, in a combustion chamber of the engine, of a driving fuel transferred in the chamber from a fuel cartridge by a fuel intake electric device comprising a valve which, upon each shot, opens in an intake position, under action of a current ($I_A$) in a component created by a voltage injection control signal ($U_v$), wherein upon a first one of a series of shots and after a beginning of the control signal, a time $t_o$ is detected of a drop of current during a transient rise of current and, an opening period $T_o$ of the valve being predetermined, an end of the injection control signal is triggered at a time $t_d$, after the period $T_o$, following the time $t_o$, reduced with a period $T_{OFF}$, of a first rise of the voltage injection control signal following a beginning of the drop of the current signal in said component or the rise, following the beginning of the drop thereof, of the current signal in said component.

2. A controlling method according to claim 1, wherein the method is implemented upon each shot.

3. A controlling method as claimed in claim 1, wherein a discharge of the component, from the fuel intake electric device and the current of which opens the valve, being stabilized, the end of the injection control signal is triggered at the time $t_d$, after a period $T_o$, following the time $t_o$, reduced with a practically constant period $T_{OFF}$ of a first rise of the voltage injection control signal.

4. A controlling method according to claim 1, wherein a discharge of the component, from the fuel intake electric device and the current of which opens the valve, being not stabilized, the end of the injection control signal is triggered at the time $t_d$, after a period $T_o$ following the time $t_o$, reduced with an estimated period $T_{OFF}$, of a rise, following a beginning of the drop thereof, of the current signal in said component.

5. A controlling method according to claim 4, wherein a period $T_{OFF}$ of the rise of the current signal in said component following the beginning of the drop thereof is measured at the time $t_d$ and is substituted for the estimated period $T_{OFF}$ at least for the following one of the series of shots.

6. A controlling method according to claim 1, wherein the method comprises:

detecting, upon the first one of a series of shots and after the beginning of the control signal, the time $t_o$, of a drop of current during the transient rise of current and, the opening period $T_o$ of the valve being predetermined, triggering the end of the injection control signal at the time $t_d$, after a period $T_o$, following the time $t_o$, reduced with a period $T_{OFF}$, of a first rise of the voltage injection control signal following the beginning of the drop of the current signal in said component or the rise, following the beginning of the drop thereof, of the current signal in said component.

7. A controlling method according to claim 1, wherein the method comprises:

detecting, upon the first one of a series of shots and after the beginning of the control signal, the time $t_o$ of the opening of the valve, the opening thereof being detected through a pressure increase at the outlet of the fuel intake electric device, and, the opening period $T_o$ of the valve being predetermined, the end of the injection control signal is triggered at the time $t_d$, after a period $T_o$, following the time $t_o$, reduced with an estimated period $T_{OFF}$, elapsing from the end of the injection control signal, until the time $t_f$ of closing of the valve being detected by the decrease of pressure at the outlet of fuel intake electric device, the true period $T_{OFF}$ of the drop of pressure following the beginning of the drop of current ($t_d$) is measured and is substituted for the estimated period $T_{OFF}$ at least for the following shot of the series of shots.

8. A controlling method for an internal combustion engine hand tool, for driving in a supporting material fastening elements under an action, upon a shot, of the firing, in a combustion chamber of the engine, of a driving fuel transferred in the chamber from a fuel cartridge by a fuel intake electric device comprising a valve which, upon each shot opens in an intake position, under an action of a current ($I_A$) in a component created by a voltage injection control signal ($U_v$), and a pressure sensor being mounted at an outlet of the fuel intake electric device, said method being characterized in that, upon the first one of a series of shots and after a beginning of a control signal, a time $t_o$ of an opening of the valve detecting an opening thereof is detected through a pressure increase at the outlet of the fuel intake electric device, and, the opening period $T_o$ of the valve being predetermined, an end of the injection control signal is triggered at a time $t_d$, after a period $T_o$, following the time $t_o$, reduced with an estimated period $T_{OFF}$, elapsing from the end of the injection control signal, until a time $t_f$ of closing of the valve being detected by a decrease of pressure at an outlet of the fuel intake electric device, the period $T_{OFF}$ of a drop of pressure following a beginning of the drop of current ($t_d$) is measured and is substituted for an estimated period $T_{OFF}$ at least for a following shot of a series of shots.

9. A controlling method according to claim 1, wherein the voltage injection control signal ($U_v$) is a slot.

10. A controlling method according to claim 1, wherein the voltage injection control signal ($U_v$) is an envelope of a series of impulsions.

11. An internal combustion engine hand tool, for driving in a supporting material fastening elements under an action, upon a shot, of a firing of a driving fuel in an engine combustion chamber, transferred in the chamber from a fuel cartridge by a fuel intake electric device comprising a valve which, upon each shot, opens in an intake position under an action of a current ($I_A$) in a component created by a voltage injection control signal ($U_v$), said tool being characterized in that it further comprises a current measurement member in series with the fuel intake electric device and a microcontroller arranged for receiving an outlet signal of the current measurement member, and a control impulsion signal for the fuel intake electric device and compute an opening time of the fuel intake electric device, wherein the outlet signal of the current measurement member and the control impulsion ($U_v$) signal are received by the microcontroller as separate signals.

12. A hand tool according to claim 11, wherein the microcontroller comprises a processing circuit for detecting a mechanical opening and closing of the fuel intake electric device.

13. A hand tool according to claim 12, wherein the fuel intake electric device is controlled by a power stage controlled by a circuit of the microcontroller for calculating an opening time of the fuel intake electric device and connected, at the input, to a processing circuit of the microcontroller.

14. A hand tool according to claim 11, wherein the fuel intake electric device is a solenoid valve comprising a coil and the current measurement member is operated in series with the coil.

15. A hand tool according to claim 11, wherein there is provided a voltage protecting, controlling and stabilization circuit in parallel on the fuel intake electric device.

16. A hand tool according to claim 15, wherein said protecting and controlling circuit comprises a Zener diode for voltage protection and stabilization control.

17. A hand tool according to claim 16, wherein the Zener diode (19) is serially mounted with a discharge diode.

18. An internal combustion engine hand tool, for driving in a supporting material fastening elements under an action, upon a shot, of a firing of a driving fuel in an engine combustion chamber, transferred in the chamber from a fuel cartridge by a fuel intake electric device comprising a valve which, upon each shot, opens in an intake position under an action of a current ($I_A$) in a component created by a voltage injection control signal ($U_v$), said tool being characterized in that it further comprises a current measurement member in series with the fuel intake electric device and a microcontroller arranged for receiving an outlet signal of the current measurement member, and a control impulsion signal for the fuel intake electric device and compute an opening time of the fuel intake electric device, wherein there is provided a pressure sensor at a outlet of the fuel intake electric device.

* * * * *